US009210745B2

(12) United States Patent
Liu et al.

(10) Patent No.: US 9,210,745 B2
(45) Date of Patent: Dec. 8, 2015

(54) DRIVING DEVICE FOR ILLUMINATING DEVICE, ILLUMINATING DEVICE AND LUMINAIRE, DRIVING DEVICE HAVING DISTRIBUTED INDUCTANCE

(71) Applicant: OSRAM GmbH, Munich (DE)

(72) Inventors: Yaping Liu, Guangdong (CN); Hui Jia, Guangdong (CN); Middel Tjaco, Guangdong (CN); Daxin Lin, Guangdong (CN)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/377,882

(22) PCT Filed: Jan. 25, 2013

(86) PCT No.: PCT/EP2013/051444
§ 371 (c)(1),
(2) Date: Aug. 11, 2014

(87) PCT Pub. No.: WO2013/120681
PCT Pub. Date: Aug. 22, 2013

(65) Prior Publication Data

US 2015/0002033 A1 Jan. 1, 2015

(30) Foreign Application Priority Data

Feb. 17, 2012 (CN) ..... 2012 1 0037287

(51) Int. Cl.
*H05B 33/08* (2006.01)
*F21V 23/02* (2006.01)

(52) U.S. Cl.
CPC ..... *H05B 33/0809* (2013.01); *H05B 33/0812* (2013.01); *H05B 33/0821* (2013.01); *H05B 33/0845* (2013.01); *F21V 23/02* (2013.01)

(58) Field of Classification Search
USPC ..... 315/274–289, 185 S, 291, 307–326
See application file for complete search history.

(56) References Cited

U.S. PATENT DOCUMENTS

| | | | | |
|---|---|---|---|---|
| 8,120,278 | B2 * | 2/2012 | Choi et al. | 315/294 |
| 2011/0133669 | A1 * | 6/2011 | Ger et al. | 315/294 |
| 2012/0049624 | A1 * | 3/2012 | Lee et al. | 307/31 |

FOREIGN PATENT DOCUMENTS

| | | | |
|---|---|---|---|
| EP | 2099260 | A1 | 9/2009 |
| EP | 2161969 | A2 | 3/2010 |

OTHER PUBLICATIONS

International Search Report issued on May 3, 2013 in application No. PCT/EP2013/051444.

* cited by examiner

*Primary Examiner* — Tuyet Vo

(57) ABSTRACT

A driving device for an illuminating device may include a plurality of sub illuminating units. The driving device may include a plurality of sub driving modules in series connected to an input voltage source to distributively store energy from the input voltage source. Each of the sub driving modules is allocated with and electrically connected with one sub illuminating unit so as to release the stored energy to the sub illuminating unit allocated thereto.

13 Claims, 1 Drawing Sheet

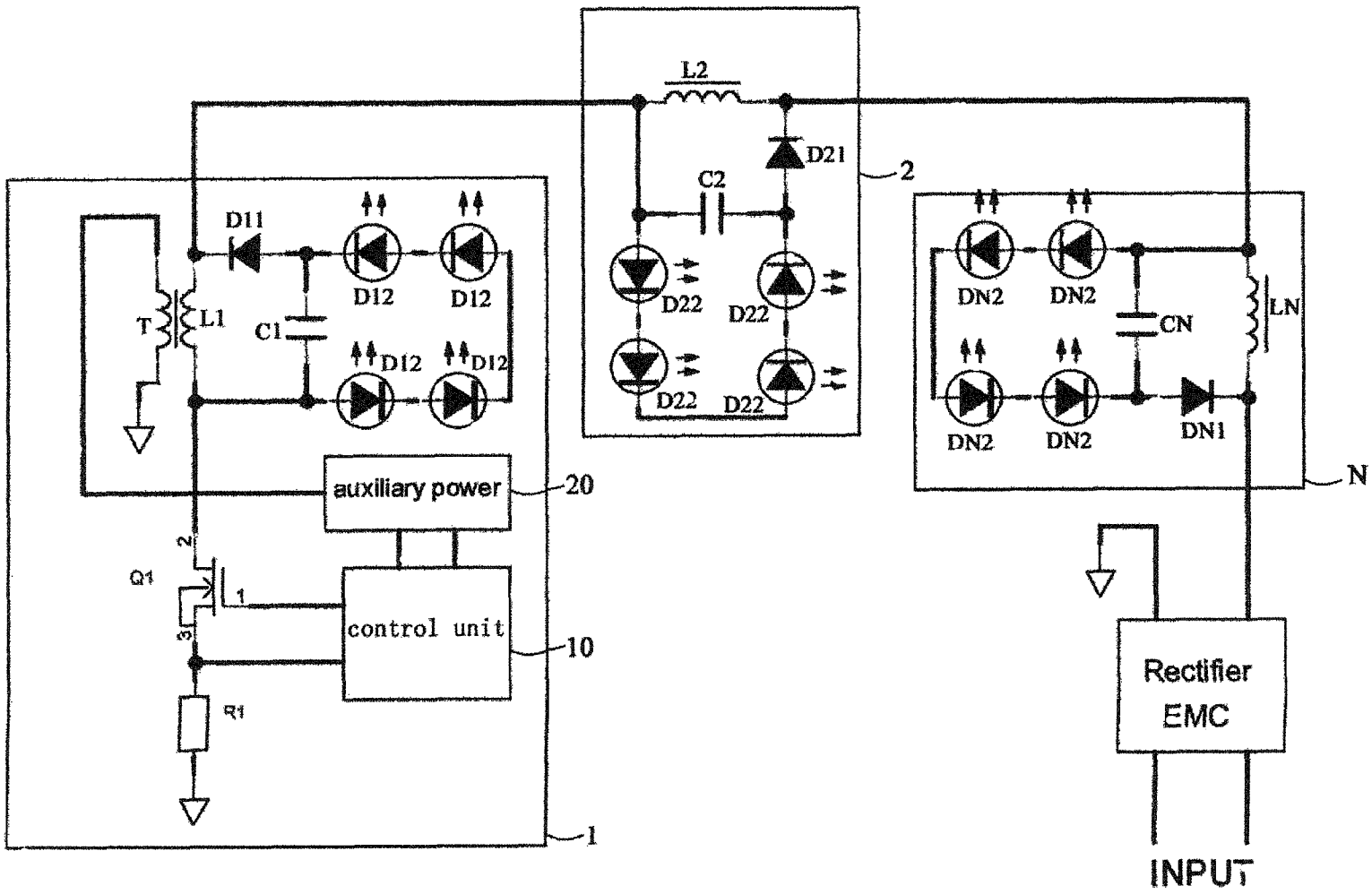
N
LN
CN
DN1
DN2
DN2
DN2
DN2
Rectifier
EMC
INPUT
2
L2
C2
D21
D22
D22
D22
D22
20
10
1
auxiliary power
control unit
D11
D12
D12
D12
D12
C1
L1
T
Q1
R1

DRIVING DEVICE FOR ILLUMINATING DEVICE, ILLUMINATING DEVICE AND LUMINAIRE, DRIVING DEVICE HAVING DISTRIBUTED INDUCTANCE

RELATED APPLICATIONS

The present application is a national stage entry according to 35 U.S.C. §371 of PCT application No.: PCT/EP2013/051444 filed on Jan. 25, 2013, which claims priority from Chinese application No.: 201210037287.6 filed on Feb. 17, 2012, and is incorporated herein by reference in its entirety.

TECHNICAL FIELD

Various embodiments relate to a driving device for an illuminating device, an illuminating device and a luminaire.

BACKGROUND

At present, LED is widely used in illuminating devices, for instance, for forming an LED lamp, due to its high efficiency and high output flux. However, taking the driver to be matched with the LED lamp into consideration, there is a problem in thin and narrow spaces for the LED lamp having a big volume, that is, the space for installing a driver is quite limited in a thin and narrow LED lamp. Thus, the current LED lamps have a big volume as the cubic single driver installed therein has a big volume and are not conveniently mounted by customers in practical applications. In addition, in the current market, customers would like to simply mount the LED lamps just like mounting traditional lamps. That is to say, it is unwanted to have too much connection that complexes the structure of the LED lamp and too much carefulness for preventing problems such as safety problem in installation are not desirable.

However, in the existing technical solutions, as the space for a driver circuit is limited, said object is difficult to be achieved. Moreover, the current technical personnel have a technical prejudice, that is, the person skilled in the art, under the influence of the structure of traditional lamps, always would consider using a big single driver to drive all LEDs in series. But in order to realize the regular performances of the LED lamps, parts such as optical structure, heat sink and cover could hardly be manufactured to be smaller. Thus, in the existing solutions, the volume of a single driver driving the LED is always intended to be reduced, but as to a single inductor (or transformer) used for the single driver, it is really hard to be manufactured smaller as the frequency is impossible to be too high.

A solution currently used is a power supply having a high switching frequency, and a magnetic material having a high performance is employed to suppress EMC noises, but the effect is quite poor.

Besides, for a more efficient and smaller inductor and a simple circuit, there is no appropriate insulation structure, the layout on a single layer of MCPCB is difficult to be carried out, and it's impossible to arrange through holes in PCB.

SUMMARY

Various embodiments provide a driving device for an illuminating device, an illuminating device and a luminaire. The driving device has a small volume, and the layout thereof on the circuit board is easier and safer.

According to various embodiments, a driving device for an illuminating device is provided. The illuminating device may include a plurality of sub illuminating units, the driving device may include a plurality of sub driving modules in series connected to an input voltage source to distributively store energy from the input voltage source, each of the sub driving modules is allocated with and electrically connected with one sub illuminating unit so as to release the stored energy to the sub illuminating unit allocated thereto.

Further, each sub driving module and the sub illuminating unit allocated thereto are arranged on the same circuit board.

Further, respective sub driving module may include an inductor, and the inductors of the plurality of sub driving modules are connected in series with each other.

And further, respective sub driving module may further include a capacitor, and the capacitor and corresponding inductor constitute an LC oscillation circuit.

And further, the plurality of sub driving modules are arranged on the same circuit board.

And further, the inductors of the plurality of sub driving modules are the same.

And further, the plurality of sub driving modules have no common ground. And further, arrangement locations of the plurality of sub driving modules on the same circuit board are different from each other.

And further, respective sub driving module may further include a diode having an anode connected with one terminal of the inductor and a cathode connected to one end of the capacitor.

And further, respective illuminating unit may include an LED array formed by a plurality of LEDs in series, an anode of the LED array is connected to an intermediate node between the inductor and the capacitor, and a cathode of the LED array is connected to an intermediate node between the capacitor and an anode of the diode.

And further, the driving device may further include a control unit, one of the sub driving modules closest to the control unit may further include an auxiliary winding inductively coupled with the inductor in this sub driving module so as to supply energy to the control unit.

And further, the input voltage source is a NET grid power source. According to various embodiments, an illuminating device is provided, including the driving device of any type described above.

According to various embodiments, a luminaire is provided, including the illuminating device of any type described above. The essence of a switching power supply is transmission between electrical and magnetic fields. The traditional NET grid power is a constant voltage source, induction coil is the opposition element without power dissipation, thus the inductor stores energy from the constant voltage source, and then the energy is released to other components in following period. In the present disclosure, energy can be stored in several inductors as water flows into several containers. For this reason, a plurality of same sub driving modules are arranged on the circuit board in the present disclosure so as to transfer energy to LEDs, in which case, an induction device having a big volume is divided into several patches of inductors, and the volume of each inductor will become smaller. This structure leads to great and unexpected changes to the volume of the lamp.

The beneficial effects obtained in the present disclosure are as follows: total energy from the input voltage source (for example a NET grid power voltage such as municipal power network) is distributed, and the energy after distribution is stored in inductors of the plurality of sub driving modules, respectively, and then the energy is released to a plurality of LED arrays directly. Hence, there is no need to store total energy from the input voltage in a single inductor, thus avoiding a big volume of the LED lamp. Moreover, since a plurality of sub driving modules with storage of energy are arranged in different locations in the present disclosure, there is less cross of wires on the MCPCB, thus, the layout of the whole circuit is easier and safer.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIG. 1 is a schematic circuit diagram of an induction device of an exemplary embodiment of the present disclosure.

DETAILED DESCRIPTION

The following detailed description refers to the accompanying drawing that show, by way of illustration, specific details and embodiments in which the disclosure may be practiced.

The present disclosure will be described more comprehensively hereinafter with reference to the figure showing an exemplary embodiment of the present disclosure. However, the present disclosure can be implemented in various different modes but should not be limited to the exemplary embodiment illustrated herein for configuration. Of course, the exemplary embodiments provided herein aims at making the disclosure more comprehensively and completely, and the scope of the present disclosure can be conveyed sufficiently to the person skilled in the art. Next, the present disclosure will be explained in detail with referent to the FIGURE.

FIG. 1 shows a schematic circuit diagram of an induction device of an exemplary embodiment of the present disclosure.

In a driving device for an illuminating device shown in FIG. 1, it is schematically shown the driving device including a plurality of sub driving modules. In FIG. 1, block 1, block 2 and block N are shown. Specifically, each of the block 1, block 2 and block N includes a sub driving module, and each sub driving module includes an inductor L1, L2, LN and a capacitor C1, C2, CN coupled with the inductor, and the inductor L1, L2, LN and the capacitor C1, C2, CN constitute an LC oscillation circuit, wherein N is an integer, and a value thereof can be selected by the skilled person according to the volume of the designed LEDs. That is, N can be any value greater than 2, for instance, N is 3, 4 or 5, etc. Preferably, each LC oscillation circuit includes a diode D11, D21, DN1. As shown in FIG. 1, an anode of the diode D11, D21, DN1 is connected with one terminal of the inductor L1, L2, LN, and a cathode of the diode D11, D21, DN1 is connected with one terminal of the capacitor C1, C2, CN.

It can be seen from FIG. 1 that theses block 1, block 2 and block N are connected in series, and preferably jointly connected to the same input voltage source. The same input voltage source can be a NET grid power source such as municipal power network. Each sub driving module is electrically connected with at least one corresponding sub illuminating unit so as to release the stored energy to the corresponding at least one sub illuminating unit. For example, as schematically shown in FIG. 1, the inductor L2 in the block 2 is connected to an LED array formed by four LEDs D22 in series.

Preferably, inductors of the plurality of sub driving modules are the same. For example, the inductors L1, L2, LN in the block 1, block 2 and block N shown in FIG. 1 can be the same. Of course, the present disclosure may not be limited to this, that is, the skilled person can change the number of LEDs in an LED array corresponding to a sub driving module depending upon requirements, and correspondingly change the volume of the corresponding inductors, so as to form sub driving modules different from each other.

The plurality of sub driving modules shown in FIG. 1 are arranged on the same circuit board. And as shown in FIG. 1, the plurality of sub driving modules are connected in series to the same input voltage source, and further the inductors corresponding to the plurality of sub driving modules are also connected in series. As mentioned above, each of these sub driving modules has a corresponding LED array formed by corresponding LEDs D12, D22, DN2 in series. Preferably, each sub driving module and its corresponding LED array are arranged on the same circuit board. And further, the LEDs in series form an LED array, an anode of the LED array is connected to an intermediate node between the inductor and the capacitor, and a cathode of the LED array is connected to an intermediate node between the capacitor and an anode of the diode. For example, with reference to FIG. 1, an anode of an LED array formed by four LEDs serially connected is connected to an intermediate node between the inductor L2 and the capacitor C2, and a cathode of the LED array is connected to an intermediate node between the capacitor C2 and an anode of the diode D21.

In addition, ground of each of the plurality of sub driving modules can be different from each other. Moreover, the arrangement locations of the plurality of sub driving modules on the same circuit board are different from each other.

Thus, in virtue of such configuration, the layout of the sub driving modules on the circuit board can be more flexible in the present disclosure. For instance, the sub driving modules can be arranged in different locations according to different locations of the LEDs. With such flexible arrangement, the cross of wires on the MCPCB becomes less, so that the wiring of the whole circuit is improved, which makes it easier for the layout of the circuit, and additionally further improves the safety of the LED lamp due to the improvement on the circuit structure.

Each of the plurality of sub driving modules is directly electrically connected with the corresponding at least one sub illuminating unit. In the traditional LED lamp, a single driver connects all LEDs in series with each other is used, that is, in the traditional technology, a single inductor is used to connect all LEDs in series, so that when any one of the LEDs is damaged, all the LEDs will be affected, and the whole lamp cannot operate. But in the present disclosure, as shown in FIG. 1, the driving device is constituted by a plurality of sub driving modules, and each sub driving module is directly electrically connected with its corresponding sub illuminating unit (i.e., LED array), thereby the service lifetime of the LED lamp is greatly improved. More specifically, in the LED lamp, for instance, when LED D22 in block 2 is damaged, it will not affect use of the LEDs in the block 1 and block N, and the damage of the LED D12 in the block 2 might lower down the luminance of the whole LED lamp but the LED lamp still can emit light. That is, the damage of the LED D22 in the block 2 will not cause damage to the whole LED lamp, thus, the service lifetime of the whole LED lamp is improved.

It can be seen from FIG. 1 that the plurality of sub driving modules are configured in a manner of buck-boost topology, that is, the structure of each of the sub driving modules can be configured to be substantially the same. Therefore, it is quite easy to design and manufacture the sub driving modules according to the present disclosure, and thus it is quite easy to design and manufacture the driver, the illuminating device and the luminaire according to the present disclosure.

In addition, as shown by the block 1 in FIG. 1, one of the plurality of sub driving modules further includes an auxiliary winding T for a control unit 10 so that an auxiliary power 20 is formed to supply power to the control unit, wherein the control unit is configured to control operation of the LED lamp. Preferably, for the sake of a compact structure, the auxiliary winding T is arranged in one sub driving module (e.g., see block 1 shown in FIG. 1) closest to the control unit 10. In the present disclosure, the structure of the auxiliary winding T is substantially the same as that in the prior art, with exception of that the auxiliary winding T is arranged in one of the plurality of sub driving modules, and repeated descriptions will not be provided herein. As shown in FIG. 1, a plurality of sub driving modules in series can be arranged on one circuit board, and each sub driving module is corresponding to its respective LED array. As the LEDs and the driver are integrated on the same circuit board, there is no non-insulation circuit. Moreover, since the buck-boss topology structure is used, it is suitable for installation in a thin and narrow space. Each of all units (such as block 1, block 2 and block N shown in FIG. 1) has a corresponding LED array. As a result, an LED lamp that has a small volume can be realized, of which the layout on the circuit board is easier and safer.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A driving device for an illuminating device comprising a plurality of sub illuminating units, wherein the driving device comprises a plurality of sub driving modules in series connected to an input voltage source to distributively store energy from the input voltage source, each of the sub driving modules is allocated with and electrically connected with one sub illuminating unit so as to release the stored energy to the sub illuminating unit allocated thereto, and wherein the driving device further comprises a control unit, one of the sub driving modules closest to the control unit further comprises an auxiliary winding inductively coupled with the inductor in this sub driving module so as to supply energy to the control unit.

2. The driving device according to claim 1, wherein the input voltage source is a NET grid power source.

3. The driving device according to claim 1, wherein respective sub driving module comprises an inductor, and inductors of the plurality of sub driving modules are connected in series with each other.

4. The driving device according to claim 3, wherein respective sub driving module further comprises a capacitor, and the capacitor and corresponding inductor constitute an LC oscillation circuit.

5. The driving device according to claim 4, wherein respective sub driving module comprises a diode having an anode connected with one terminal of the inductor and a cathode connected to one end of the capacitor.

6. The driving device according to claim 5, wherein respective illuminating unit comprises an LED array formed by a plurality of LEDs in series, an anode of the LED array is connected to an intermediate node between the inductor and the capacitor, and a cathode of the LED array is connected to an intermediate node between the capacitor and an anode of the diode.

7. The driving device according to claim 1, wherein each sub driving module and the sub illuminating unit allocated thereto are arranged on the same circuit board.

8. The driving device according to claim 7, wherein the inductors of the plurality of sub driving modules are the same.

9. The driving device according to claim 7, wherein the plurality of sub driving modules have no common ground.

10. The driving device according to claim 7, wherein the plurality of sub driving modules are arranged on the same circuit board.

11. The driving device according to claim 10, wherein arrangement locations of the plurality of sub driving modules on the same circuit board are different from each other.

12. An illuminating device, comprising a driving device the driving device comprising:

a plurality of sub illuminating units, wherein the driving device comprises a plurality of sub driving modules in series connected to an input voltage source to distributively store energy from the input voltage source, each of the sub driving modules is allocated with and electrically connected with one sub illuminating unit so as to release the stored energy to the sub illuminating unit allocated thereto, and wherein the driving device further comprises a control unit, one of the sub driving modules closest to the control unit further comprises an auxiliary winding inductively coupled with the inductor in this sub driving module so as to supply energy to the control unit.

13. A luminaire, comprising an illuminating device, the illuminating device comprising a driving device, the driving device comprising:

a plurality of sub illuminating units, wherein the driving device comprises a plurality of sub driving modules in series connected to an input voltage source to distributively store energy from the input voltage source, each of the sub driving modules is allocated with and electrically connected with one sub illuminating unit so as to release the stored energy to the sub illuminating unit allocated thereto, and wherein the driving device further comprises a control unit, one of the sub driving modules closest to the control unit further comprises an auxiliary winding inductively coupled with the inductor in this sub driving module so as to supply energy to the control unit.

* * * * *